US006142755A

United States Patent [19]

Shiinoki et al.

[11] Patent Number: 6,142,755

[45] Date of Patent: Nov. 7, 2000

[54] SCROLL COMPRESSOR AND METHOD OF MANUFACTURING SAME

[75] Inventors: Kazuaki Shiinoki; Isamu Kawano; Natsuki Kawabata; Akira Suzuki, all of Shimizu; Tatsuo Natori, Kashiwa; Muneo Mizumoto, Tsuchiura; Shigeru Machida, Ibaraki-ken, all of Japan

[73] Assignee: Hitachi, Ltd., Tokyo, Japan

[21] Appl. No.: 09/109,180

[22] Filed: Jul. 2, 1998

[30] Foreign Application Priority Data

Sep. 19, 1997 [JP] Japan ..... 9-254699

[51] Int. Cl.[7] ..... F04C 18/00

[52] U.S. Cl. ..... 418/55.2; 418/178; 418/55.4; 418/142; 29/888.22

[58] Field of Search ..... 418/55.2, 178, 418/55.4, 142, 888.22; 29/888.22

[56] References Cited

U.S. PATENT DOCUMENTS

| | | | |
|---|---|---|---|
| 4,732,550 | 3/1988 | Suzuki et al. | 418/142 |
| 5,357,164 | 10/1994 | Imabayashi et al. | 310/323 |
| 5,775,892 | 7/1998 | Miyashaka et al. | 418/55.2 |
| 5,897,965 | 4/1999 | Itoh et al. | 428/652 |

FOREIGN PATENT DOCUMENTS

| | | | |
|---|---|---|---|
| 0157315 | 12/1979 | Japan | 418/55.2 |
| 0197794 | 9/1986 | Japan | 418/55.2 |
| 0146201 | 6/1990 | Japan | 418/55.2 |
| 0308902 | 12/1990 | Japan | 418/55.2 |
| 405240174 | 9/1993 | Japan | 418/55.2 |

*Primary Examiner*—Thomas Denion
*Assistant Examiner*—Thai-Ba Trieu
*Attorney, Agent, or Firm*—Antonelli, Terry, Stout & Kraus, LLP

[57] ABSTRACT

An oil-free scroll compressor used for compression of air or the like, comprises an orbiting scroll having a spiral-shaped lap or laps formed on one or both sides of an end plate, and a stationary scroll having a lap or laps adapted to mate with the orbiting scroll to define a compression chamber or chambers.

Grooves are formed on tips of the respective scroll laps, and elastic tip seals are fitted into the grooves in order to prevent leakage of compressed gas from between the laps and the end plates. Those surfaces of the orbiting scroll and of the stationary scroll or scrolls, which define the compression chamber or chambers, are subjected to surface treatment in order to prevent seizure or the like caused by sliding of the tip seals and the laps. The stationary scroll or scrolls are subjected to an anodizing coating treatment while the orbiting scroll is subjected to Ni—P—B treatment.

15 Claims, 5 Drawing Sheets

SCROLL COMPRESSOR AND METHOD OF MANUFACTURING SAME

BACKGROUND OF THE INVENTION

The present invention relates to a scroll compressor and, more particularly, to a scroll compressor suitably used as a compressor for air compression having an orbiting scroll with laps which are formed on one side or opposite sides of an end plate, and also to a method of manufacturing such a scroll compressor.

In conventional scroll compressors as disclosed in Japanese Patent Unexamined Publication No. 2-173472/1990, Japanese Patent Unexamined Publication No. 1-237376/1989, Japanese Patent Unexamined Publication No. 64-80785/1989 or the like, lap surfaces of a stationary scroll and an orbiting scroll are subjected to surface treatment providing a good lubrication so as to aim at reducing abrasion occurring between the scroll laps and the end plates or between the respective scroll laps, and at preventing seizure from occurring therebetween. Further, Japanese Patent Unexamined Publication No. 8-261171/1996 proposes a scroll compressor in which a stationary scroll and an orbiting scroll are both subjected to one and the same kind of surface treatment so as to aim at prolonging the service life of the scroll compressor.

In a scroll compressor in which an orbiting scroll and a stationary scroll are arranged with their laps mating with each other, revolving movements of the orbiting scroll reduces a volume of an compression working chamber, which is defined between the laps of the stationary scroll and the orbiting scroll, to compress gas therein. It is desirable in view of improvement in the performance of the scroll compressor to eliminate a gap between the laps during the operation of the scroll compressor to reduce leakage from the compression working chamber as much as possible. Accordingly, a temperature of the laps during operation is estimated to determine a gap between the laps. However, the actual scroll compressor is extremely complicated in construction, so that it is impossible to estimate a gap between the laps, which is in the order of several micron meters ($\mu$m) during operation. If the gap between the laps is too narrow, such a disadvantage would occur that the laps make contact with each other during the operation, resulting in seizure which leads to stopping of the compressor.

Accordingly, in scroll compressors as disclosed in Japanese Patent Unexamined Publication No. 2-173472/1990, Japanese Patent Unexamined Publication No. 1-237376/1989, Japanese Patent Unexamined Publication No. 62-199982/1987 and Japanese Patent Unexamined Publication No. 64-80785/1989, laps are coated with a material, which provides a good lubrication, to prevent the laps from making contact with each other. However, although this coating exhibits a satisfactory function in the initial stage of the operation, it increasingly undergoes abrasion with the operating time since a substrate material for the laps is mainly composed of aluminum, and the substrate materials are eventually brought into contact with each other to possibly cause disadvantages such as seizure or the like.

Further, in a scroll compressor disclosed in Japanese Patent Unexamined Publication No. 8-261171/1996, the same coating material is used for both stationary and orbiting scrolls, which involves the possibility of causing disadvantages such as seizure and the like in the event of poor lubrication.

SUMMARY OF THE INVENTION

The present invention is contemplated in view of the disadvantages involved in the above-mentioned prior art, and has its object to provide an oil-free scroll compressor which is prolonged its service life.

Another object of the present invention is to provide a scroll compressor which can be stably operated over a long term even when laps in the scroll compressor make contact with each other.

A further object of the present invention is to provide an oil free scroll compressor which is highly reliable to prevent occurrence of seizure or the like and is high in performance, and to provide a method of manufacturing the same.

A still further object of the present invention is to provide a highly reliable surface treatment method for an oil free scroll compressor.

To the end, in an aspect of the present invention, there is provided a scroll compressor comprising an orbiting scroll having an end plate, at least one side of which is formed with a spiral lap, and a stationary scroll having a lap adapted to mate with the orbiting scroll, either of the stationary scroll and of the orbiting scroll having a surface of the end plate and surfaces of a lap subjected to Ni—P—B surface treatment, and the other of the stationary scroll and of the orbiting scroll having a surface of the end plate and surfaces of a lap subjected to anodizing coating treatment.

Further, in a preferred form of the present invention, grooves are formed respectively on tip surfaces of the laps of the orbiting and stationary scrolls, and seal members mainly composed of a tetrafluoroethylene resin are fitted onto the grooves, respectively.

In order to achieve the above-mentioned objects, in another aspect of the present invention, there is provided a scroll compressor comprising an orbiting scroll having scroll laps on opposite side surfaces of an end plate, a pair of stationary scrolls arranged substantially in parallel with each other and having the orbiting scroll arranged therebetween, compression chambers defined on opposite sides of the end plate of the orbiting scroll, in which a gas is compressed by revolving movements of the orbiting scroll, and seal members made of a polymer material so as to have elasticity and fitted respectively into grooves, which are formed respectively on tip of the laps of the respective scrolls, and wherein lap surfaces of the stationary scrolls, including surfaces of the end plate thereof are coated with an anodizing film, and lap surfaces of the orbiting scroll, including surfaces of the end plates thereof are subjected to an Ni—P—B treatment.

Further, the above-mentioned polymer material preferably contains tetrafluoroethylene resin as a main component.

Further, in any one of embodiments, the working gas is desirably air, and the Ni—P—B film has a thickness of 10 to 30 $\mu$m, preferably about 20 $\mu$m. Further, the Ni—P—B film desirably has a surface hardness of 700 to 900 in terms of Vickers hardness.

In order to achieve the above-mentioned objects, in a still further aspect of the present invention, that surface of the orbiting scroll, which faces the stationary scroll, is coated with a Ni—P—B film, and that surface of the stationary scroll, which faces the orbiting scroll, is coated with an anodizing coating film during manufacture of the scroll compressor.

Preferably, grooves are beforehand formed on tip parts of the stationary and orbiting scrolls, and then the respective scrolls are subjected to the above-mentioned surface treatment.

DESCRIPTION OF THE PREFERRED EMBODIMENTS

Figure 1:
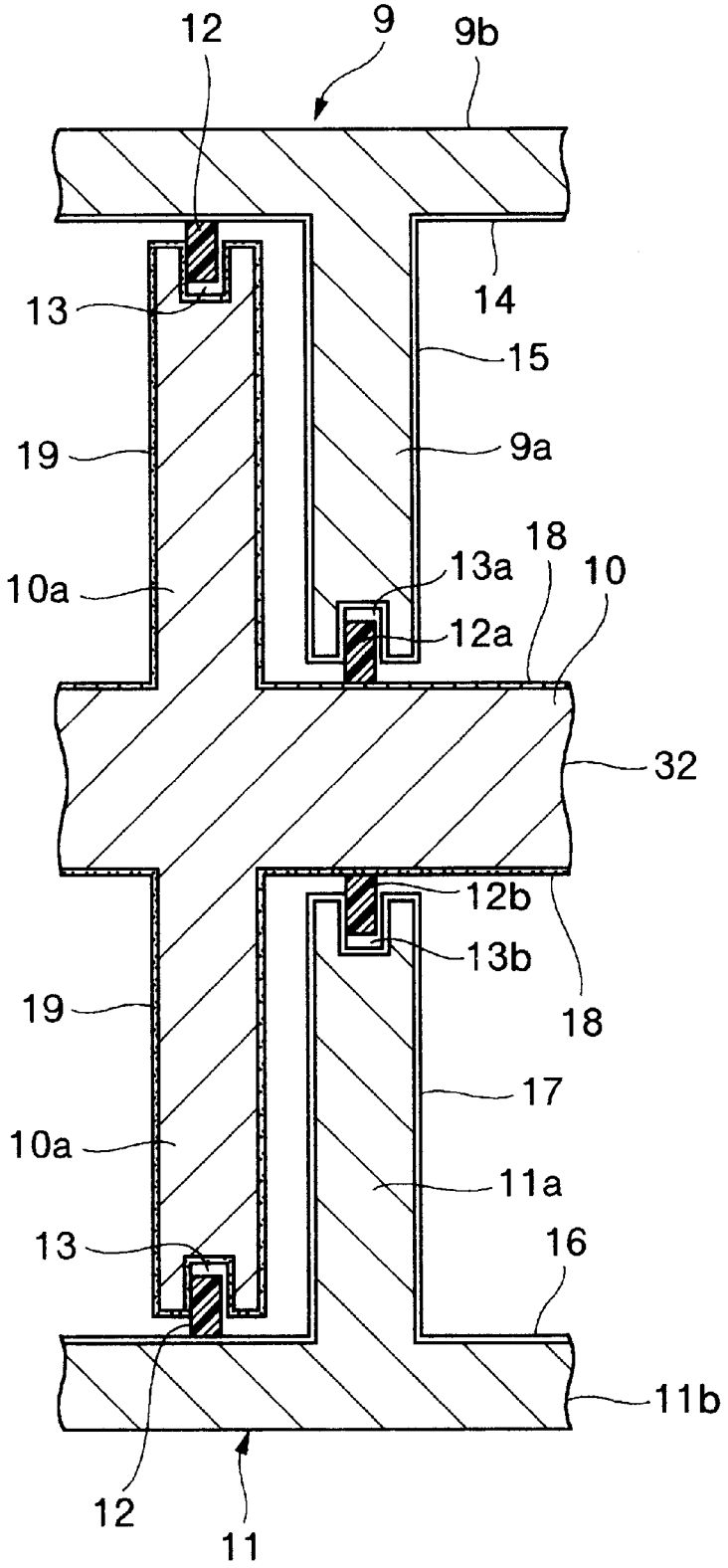
FIG. 1 is a detailed sectional view illustrating laps in one embodiment of a double scroll compressor according to the present invention.

First, explanation will be made of the background of the present invention. In an oil-free scroll compressor, a stationary scroll and an orbiting scroll perform relative motion with slight gaps between their laps, and between their laps and end plates. Incidentally, in order to make an oil-free scroll compressor highly efficient, it is desirable that these gaps are eliminated ideally. Accordingly, tip seals mainly composed of a tetrafluoroethylene resin are used for end surfaces of the laps of the orbiting and stationary scrolls. With the use of the tip seals, the gaps between the end plates and the laps are reduced in size, so that leakage loss is reduced.

Meanwhile, a gap between the respective laps of the orbiting and stationary scrolls is very hard to control since the laps formed in two-dimensional manner deform three-dimensionally due to heat generated during operation. Accordingly, even with a design taking account of deformations of the laps analyzed with a high degree of accuracy, the laps sometimes make contact with each other, resulting in seizure. Conventionally, in order to avoid such disadvantage, surfaces of the laps are coated with a material, which provides a good lubrication, and the laps perform operation with a low degree of friction and a low degree of abrasion even when they contact with each other. While with such lubrication method the compressor exhibits a satisfactory performance in a relatively short operation time, the laps increasingly undergo abrasion with the operation time with the result that the substrate materials of the laps make contact with each other.

In conventional scroll compressors, it puts stress on the efficiency of the compressors, and so configurational deformations of compression sections defined between the scroll laps and the end plates are suppressed as much as possible. On the contrary, according to the present invention, laps of one of the scrolls are enhanced in surface hardness as compared with those of the other of the scrolls, so that if the orbiting scroll laps and the stationary scroll laps should make contact with each other, the scroll laps having higher hardness could shave off the surfaces of the scroll laps having lower hardness. Thus, such shaving makes the gaps between the two laps substantially zero, so that it is possible to reduce leakage loss from the gaps defined between the laps. Briefly, abrasion caused by the contact between the laps is suppressed in the prior art while according to the present invention such abrasion is positively allowed so as to provide optimum gaps between the laps.

Explanation will be hereinbelow made of several embodiments of the present invention with reference to the accompanying drawings. FIGS. 1 to 5 are views showing a first embodiment of the present invention, FIG. 1 being a detailed sectional view illustrating laps in a scroll compressor (hereinbelow, referred to as a double scroll compressor), in which laps are formed on both surfaces of an end plate of an orbiting scroll to define compression working chambers on the both surfaces of the end plate to cancel out thrust forces exerted by compressed gases, FIG. 2 being an external perspective view illustrating the double scroll compressor, FIG. 3 being a sectional view taken orthogonally to an axis thereof, FIG. 4 being a detailed view illustrating the orbiting scroll and FIG. 5 being a detailed view illustrating a stationary scroll.

Figure 2:
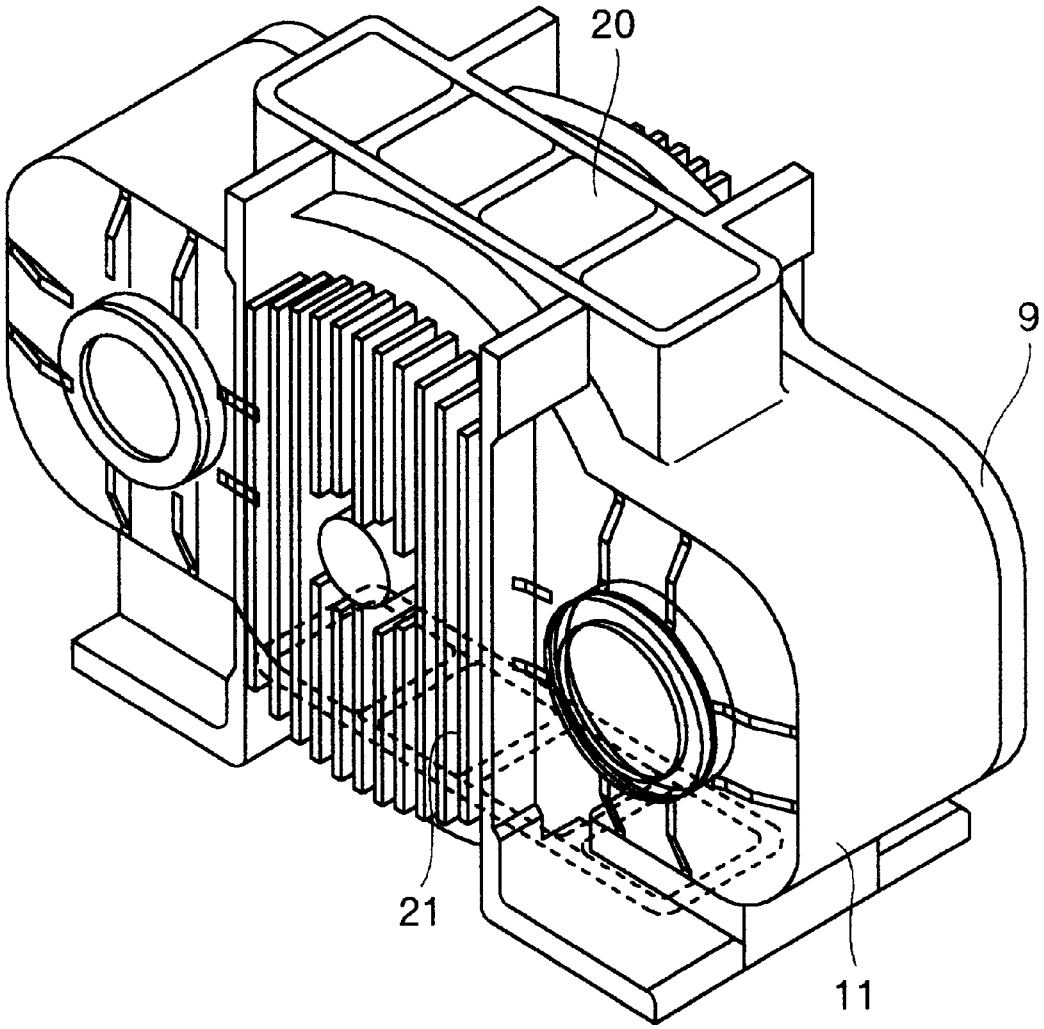
FIG. 2 is an external perspective view illustrating the embodiment of the double scroll compressor according to the present invention.

Referring to FIG. 2, the double scroll compressor includes as its main components stationary scrolls 9, 11 cast from aluminum and also serving as a casing, an orbiting scroll and a rotary shaft which are not shown in this figure. One of the stationary scrolls 11 is formed with an intake port 20, through which an outside air is introduced to be partly used for cooling of the scroll compressor and be further partly used as a working gas, and a discharge port 21.

Figure 3:
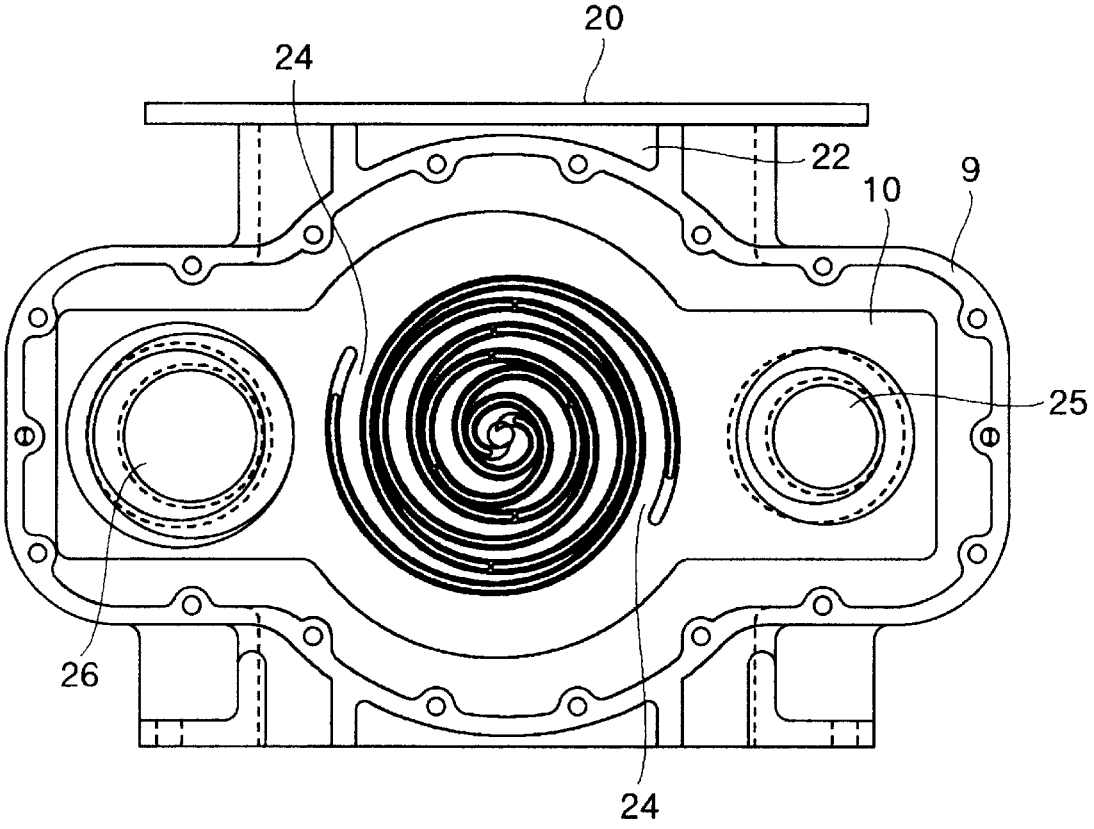
FIG. 3 is a cross-sectional view illustrating the embodiment of the double scroll compressor according to the present invention.
Figure 4:
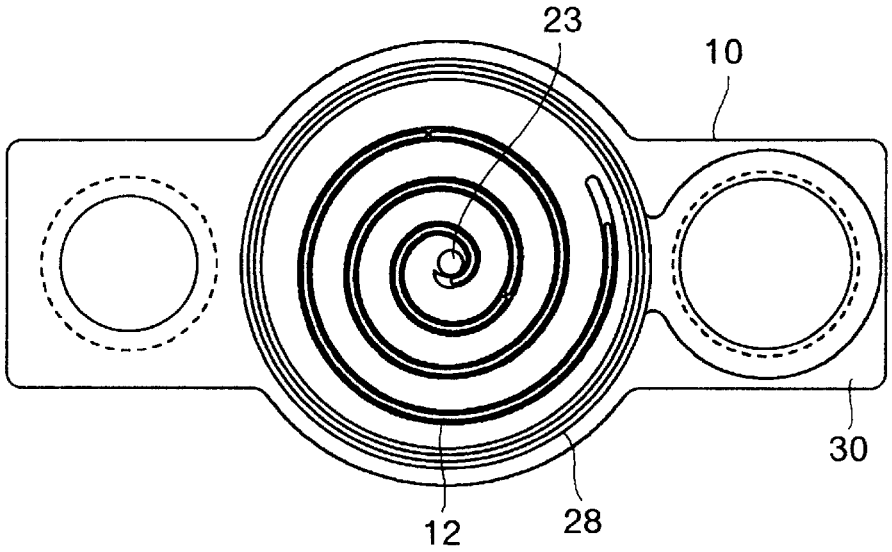
FIG. 4 is a front view illustrating an orbiting scroll of an embodiment of a double scroll compressor according to the present invention.

FIG. 3 is a cross-sectional view illustrating the double scroll compressor shown in FIG. 2 with laps of the orbiting and stationary scrolls mating with each other. Crankshafts (not shown) are held in rotary shaft holding holes 25, 26 by means of bearings. When a drive force transmitted from a drive machine (also not shown) is applied to the crankshafts, the orbiting scroll 10 formed on the both surfaces of the end plate with spiral laps revolves without revolution on its axis. A part of the air sucked through the intake port 20 creates compression chambers 24 between the laps formed on the stationary scrolls 9, 11 and the laps formed on the orbiting scroll 10 owing to the revolving motion of the orbiting scroll.

As the orbiting scroll 10 revolves, the compression chambers 24 are reduced in volume, so that the air in the compression chambers 24 is compressed and then discharged outside the compressor as a high pressure gas, through the discharge port 23 formed centrally of the laps. Grooves are formed in axial end surfaces of the laps, and tip seals 12 are fitted onto the grooves. These tip seals prevent the working gas from leaking through between the stationary scroll laps and the end plate 30 of the orbiting scroll and through between the orbiting scroll laps and the stationary scroll laps.

Figure 5:
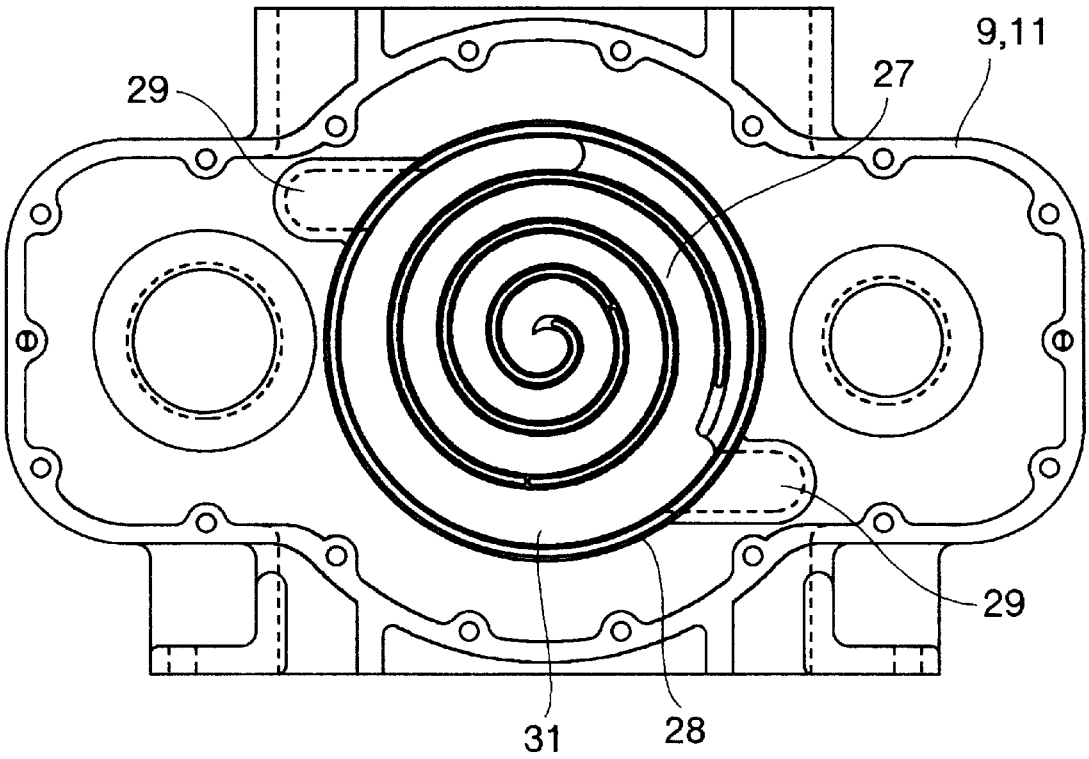
FIG. 5 is a front view illustrating a stationary scroll in the embodiment of the double scroll compressor according to the present invention.

The stationary scrolls 9, 11 have a lap 27 and an end plate 31 as shown in FIG. 5, and a dust lap 28 is formed on the end plate 31 to be disposed at an outer peripheral area outside of the outermost peripheral portion of the lap 27. The dust lap 28 prevents dust and dirt from entering the compression chambers. In this embodiment, suction ports are provided respectively at two positions, and accordingly, passages for introducing the working gas into the compression chamber are provided at axially symmetrical positions.

Next, detailed explanation will be made of the scroll lap of the double scroll compressor constructed as mentioned above with reference to FIG. 1 which is a longitudinal sectional view illustrating the lap. Spiral scroll laps 10*a* are formed respectively on both surfaces of the end plate 32 of the orbiting scroll. Meanwhile, stationary scroll laps 9*a*, 11*a* are formed in a spiral shape on the stationary scrolls 9, 11 to mate with the orbiting scroll laps 10*a*. Further, the stationary scrolls 9, 11 and the orbiting scroll 10 engage with each other.

Tips of the laps 10*a* of the orbiting scroll are formed with grooves 13, which receive seal members 12 for sealing the gaps between the laps 10*a* and the end plates 9*b*, 11*b*, and the seal members 12 are fitted in the grooves 13. Similarly, grooves 13*a*, 13*b* are formed at tips of the stationary scroll laps 9*a*, 11*a*, and receive seal members 13*a*, 13*b* for sealing gaps between the laps 9*a*, 11*a* and the end plate 32 of the orbiting scroll. Incidentally, the seal members are made of a tetrafluoroethylene group resin.

The stationary and orbiting scrolls are made of aluminum alloy for the purpose of making them lightweight and making the fabrication thereof ready. In general, stationary scrolls are aluminum castings to be low in surface hardness, and there is the possibility that the laps of the orbiting and stationary scrolls are brought into contact with each other. For the above reason, the lap surfaces 15, 17 of the stationary scrolls 9, 11 and the surfaces 14, 16 of the end plates are subjected to anodizing coating treatment. Further, the lap surfaces 19 and the end plate surfaces 18 of the orbiting scroll 10 are subjected to Ni—P—B treatment, which provides an adequately coating hardness as compared with that obtained by the anodizing coating treatment.

This Ni—P—B treatment is similar to that disclosed in Japanese Patent Unexamined Publication No. 8-158058/1996. However, it is noted that the treatment disclosed in this document is a surface treatment method for reduction of friction and abrasion, while according to the present invention, the coating is for the purpose of protecting the lap surfaces of the orbiting scroll and the lap surfaces of the stationary scrolls allow positive wear. In addition, the reason why the outer surfaces of the stationary scrolls are subjected to the anodizing coating treatment is to reduce abrasion of the seal members fitted into the grooves 13*a*, 13*b*. Accordingly, if abrasion of the seal members are allowed, such coating treatment may be dispensed with. A combination of the above-mentioned anodizing coating treatment and the Ni—P—B treatment provides a frictional coefficient of about 0.1 to 0.2.

During the actual operation of the scroll compressor, in which the stationary scrolls 9, 11 and the orbiting scroll 10 are subjected to the surface treatments providing substantially different coating hardness, the laps 10*a* of the orbiting scroll 10 having a sufficiently high hardness can gradually abrade the lap surfaces 15, 17 and end plate surfaces 14, 16 of the stationary scrolls 9, 11 having a low hardness even when unexpected thermal deformation exceeding an original estimate occurs to bring the laps into contact with each other. Accordingly, the laps of the stationary scrolls 9, 11 and the orbiting scroll 10 are prevented from seizure to enable stable operation of the compressor. When the laps make contact, thicknesses of abraded portions of the lap surfaces 15, 17 of the stationary scrolls 9, 11 having a low coating hardness substantially correspond to those of portions of interference between the laps 10*a* of the orbiting scroll 10 and the laps 9*a*, 11*a* of the stationary scrolls 9, 10. Accordingly, when the portions of interference have completely abraded, the compressor is operated in a state, in which minimum gaps required are ensured between the laps 9*a*, 11*a* and the laps 10*a*. Thus, the minimum gaps required can be ensured in terms of performance to prevent leakage of compressed air, which makes it possible to provide a compressor having a high performance.

The coating obtained by the Ni—P—B process used in the present invention has a thickness of 10 to 30 $\mu$m, and preferably about 20 $\mu$m. Further, this coating treatment is advantageous in that the surface hardness is not lowered even when the treatment is performed at a relative low temperature. More specifically, the orbiting scroll is made of aluminum alloy and so an upper limit of the treatment temperature is around 200° C., at which the treatment provides Vickers Surface Hardness of about 700 to 900 providing a sufficiently high hardness as compared with that obtained by the anodizing coating treatment, which involves a thickness of about 50 $\mu$m. Further, in this embodiment, a favorable result is obtained when the coating contains a nickel content of 98 wt. % or more, phosphorus content of 1 to 2 wt. %, and a boron content of 1 wt. % or less.

Figure 6:
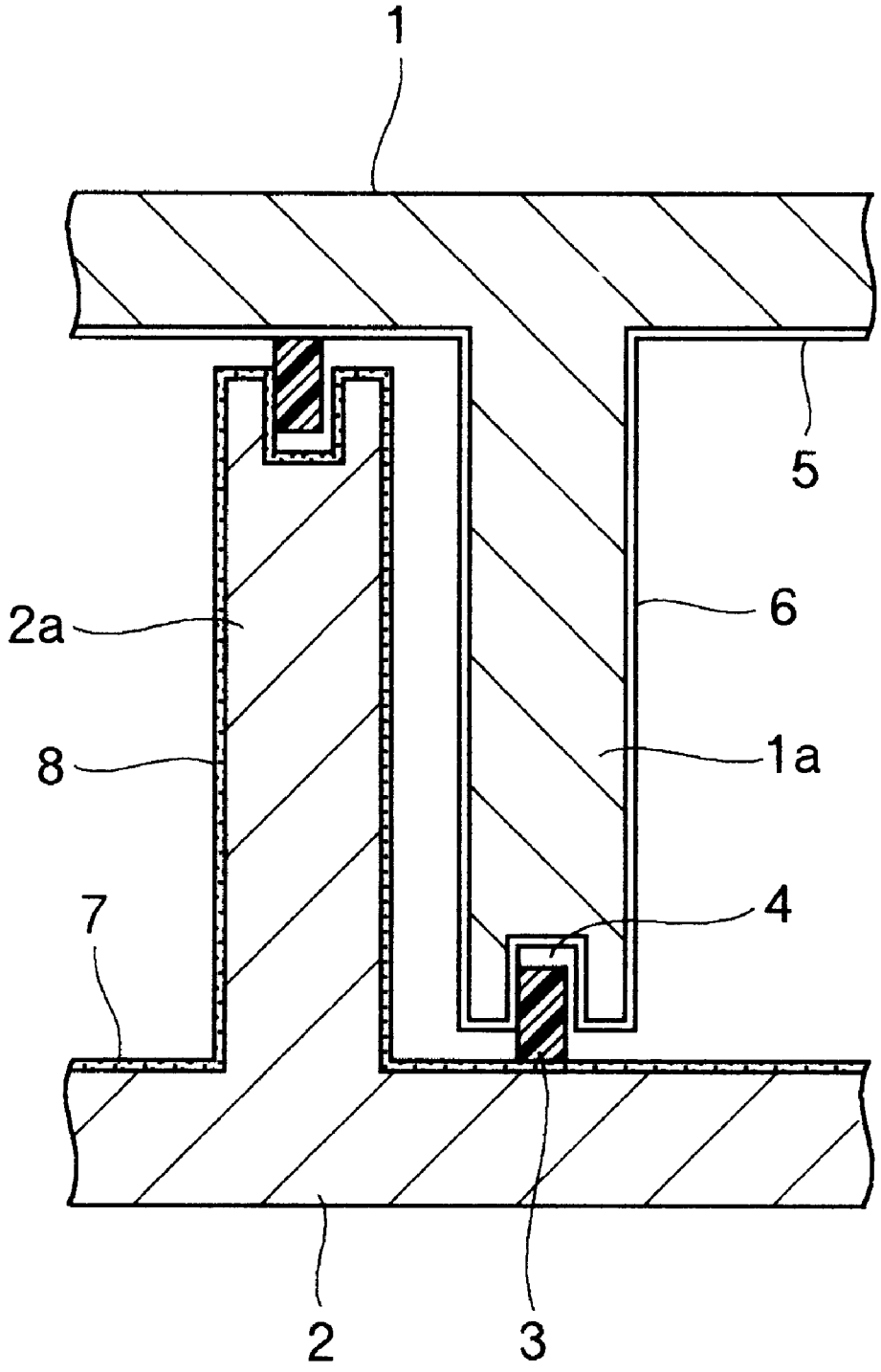
FIG. 6 is a detailed sectional view illustrating laps in an embodiment of a single scroll compressor.

Explanation will be made of a second embodiment of the present invention with reference to FIG. 6, in which the same reference numerals are used to denote the same parts as those shown in FIG. 1. In a scroll compressor according to this second embodiment, an orbiting scroll is formed on only one side of an end plate thereof with a scroll lap. Accordingly, the orbiting scroll and a stationary scroll are acted by gas pressures in the compressor, which are produced by the scroll laps, to be separated from each other. This compressor thus constructed is called a single scroll compressor, in which the stationary scroll 1 and the orbiting scroll 2 mate with each other. The respective laps 1*a*, 2*a* are formed at tips thereof with grooves 4, in which seal members 3 are fitted. The lap surface 6 and end plate surface 5 of the stationary scroll 1 are subjected to anodzing coating treatment. The lap surface 8 and end plate surface 7 of the orbiting scroll 2 are subjected to Ni—P—B treatment, which provides an adequately coating hardness as compared with that obtained by the anodizing coating treatment applied to the stationary scroll 1. During the actual operation of the scroll compressor, in which the stationary scrolls 1 and the orbiting scroll 2 are subjected to the surface treatments providing substantially different coating hardness, the laps 2*a* of the orbiting scroll 2 having a sufficiently high hardness can gradually abrade the lap surface 6 and end plate surface 5 of the stationary scrolls 1 having a low hardness even when unexpected thermal deformation exceeding an original estimate occurs to bring the laps into contact with each other. Accordingly, the laps of the stationary scrolls 1 and the orbiting scroll 2 are prevented from seizure to enable stable operation of the compressor. When the laps make contact, a thickness of an abraded portion of the lap surface 6 of the stationary scrolls 1 having a low coating hardness substantially corresponds to that of a portion of interference between the lap 2*a* of the orbiting scroll 2 and the laps 1*a* of the stationary scroll 1. Accordingly, when the portion of interference has completely abraded, the compressor is operated in a state, in which a minimum gap required is ensured between the lap 1*a* and the lap 2*a*. Thus, the minimum gap required can be ensured in terms of performance to prevent leakage of compressed air, which makes it possible to provide a compressor having a high performance.

While the stationary scroll is subjected to the surface treatment, which provides a low hardness, and the orbiting scroll is subjected to the surface treatment, which provides a high hardness, the orbiting scroll and the stationary scroll, respectively, are subjected to the surface treatments such that the stationary scroll has a high hardness and the orbiting scroll has a low hardness.

Further, the surfaces of the grooves formed at the tips of the laps are also subjected to the Ni—P—B treatment so as to facilitate such surface treatment. Accordingly, abrasion of at least one of the surface of the grooves and seal members fitted in the groove is disadvantageous, but the treatment exhibits low abrasion with respect to the seal members mainly composed of a tetrafluoroethylene resin, so that a favorable sealing performance is ensure over a long term.

According to the present invention, the orbiting scroll and the stationary scroll, respectively, are subjected to surface treatments, which provide substantially different coating hardness, so that it is possible to prevent the scrolls from seizure when the laps thereof make contact with each other, thus enabling ensuring a stable operation for the scroll compressor. Further, a gap which is minimum but necessary is formed through abrasion of the laps, so that it is possible to prevent leakage of compressed air to improve the performance of the compressor.

Further, since abrasion of the sealing members fitted in the grooves formed in the tips of the laps and the laps can be reduced, it is possible to obtain a favorable sealing performance over a long term to improve the reliability of the scroll compressor.

The present invention can be embodied in other various forms without departing from the spirit and principle features of the invention. Accordingly, the above-mentioned embodiments are merely exemplary, and should not be interpreted in a limited manner. The scope of the present invention should be defined by the appended claims, and should not be bound to the contents of the specification. Various modifications and changes within a scope equivalent to the scope defined by the claims may fall within the scope of the present invention.

What is claimed is:

1. An oil free scroll compressor comprising an orbiting scroll with an end plate, on at least one side of which is formed with a spiral lap, and a stationary scroll having a lap adapted to mate with the orbiting scroll, either of the stationary scroll and the orbiting scroll having a surface of the end plate and surfaces of the lap subjected to Ni—P—B surface treatment, and the other of the stationary scroll and the orbiting scroll having a surface of the end plate and surfaces of the lap subjected to anodizing coating treatment.

2. An oil free scroll compressor as set forth in claim 1, wherein grooves are formed on lap end surfaces of said orbiting scroll and of said stationary scroll, respectively.

3. An oil free scroll compressor as set forth in claim 2, wherein seal members mainly composed of a tetrafluoroethylene resin are fitted in said grooves, respectively.

4. An oil free scroll compressor as set forth in claim 1, wherein a working gas is air.

5. An oil free scroll compressor as set forth in claim 1, wherein said Ni—P—B coating has a thickness of 10 to 30 μm.

6. An oil free scroll compressor as set forth in claim 1, wherein said Ni—P—B coating has a Vickers surface hardness of 700 to 900.

7. An oil-free scroll compressor comprising an orbiting scroll having scroll laps on both side surfaces of an end plate, a pair of stationary scrolls arranged substantially in parallel with each other and having the orbiting scroll arranged therebetween, each of the pair of stationary scrolls having a lap adapted to mate with the orbiting scroll to define compression chambers on both sides of the end plate of the orbiting scroll, in which a gas is compressed by revolving movements of the orbiting scroll, and elastic seal members formed of a polymer material and fitted respectively into grooves, which are formed respectively on tips of the laps of the respective scrolls, and wherein surfaces of the laps of the stationary scrolls as well as surfaces of the end plate thereof are applied with an anodizing coating, and surfaces of the laps of the orbiting scroll as well as surfaces of the end plates thereof are subjected to Ni—P—B treatment.

8. An oil free scroll compressor as set forth in claim 7, wherein said polymer material contains a tetrafluoroethylene resin as a main component.

9. An oil free scroll compressor as set forth in claim 8, wherein as the working gas is air.

10. An oil free scroll compressor as set forth in claim 8, wherein said Ni—P—B coating has a thickness of 10 to 30 μm.

11. An oil free scroll compressor as set forth in claim 8, wherein said Ni—P—B coating has a Vickers surface hardness of 700 to 900.

12. An oil free method of manufacturing a scroll compressor, comprising coating that surface of the orbiting scroll, which faces the stationary scroll, with a Ni—P—B film, and coating that surface of the stationary scroll, which faces the orbiting scroll, with an anodizing coating.

13. An oil free method of manufacturing a scroll compressor as set forth in claim 12, wherein grooves are beforehand formed on tips of laps of the stationary and orbiting scrolls, and then the respective scrolls are subjected to said surface treatment.

14. An oil-free scroll compressor as set forth in claim 7, wherein the Ni—P—B treatment provides a coating on the surfaces of the laps and end plate of the orbiting scroll, said coating comprising 98 wt % or more Ni, 1–2 wt % P, and 1 wt % or less B.

15. An oil-free scroll compressor as set forth in claim 1, wherein the Ni—P—B treatment provides a coating on the surfaces of the lap and end plate of either of the stationary scroll and the orbiting scroll, said coating comprising 98 wt % or more Ni, 1–2 wt % P, and 1 wt % or less B.

* * * * *